US010175016B2

(12) United States Patent
Keys

(10) Patent No.: US 10,175,016 B2
(45) Date of Patent: Jan. 8, 2019

(54) SYSTEM AND METHOD FOR DISPLAYING THE NUMBER OF ROUNDS IN A MAGAZINE OF A WEAPON

(71) Applicant: Daniel James Keys, Belle Center, OH (US)

(72) Inventor: Daniel James Keys, Belle Center, OH (US)

(73) Assignee: ZYNO ENGINEERING, LLC, Belle Center, OH (US)

( * ) Notice: Subject to any disclaimer, the term of this patent is extended or adjusted under 35 U.S.C. 154(b) by 0 days.

(21) Appl. No.: 15/380,611

(22) Filed: Dec. 15, 2016

(65) Prior Publication Data

US 2018/0172377 A1 Jun. 21, 2018

(51) Int. Cl.

| | |
|---|---|
| ***F41A 9/62*** | (2006.01) |
| *F41A 9/65* | (2006.01) |
| *F41A 9/72* | (2006.01) |

(52) U.S. Cl.
CPC *F41A 9/62* (2013.01); *F41A 9/65* (2013.01); *F41A 9/72* (2013.01)

(58) Field of Classification Search
CPC ..... F41A 9/53; F41A 9/62; F41A 9/65; F41A 9/72; F41A 19/01; F41G 1/345
USPC ..... 42/1.01–1.05
See application file for complete search history.

(56) References Cited

U.S. PATENT DOCUMENTS

| | | | | | |
|---|---|---|---|---|---|
| 4,142,313 | A * | 3/1979 | Musgrave | F41A 9/62 | 42/1.02 |
| 5,142,805 | A * | 9/1992 | Home | F41A 9/62 | 42/1.02 |
| 5,592,769 | A * | 1/1997 | Villani | F41A 9/62 | 42/1.02 |
| 5,826,360 | A * | 10/1998 | Herold | F41A 9/62 | 42/1.02 |
| 8,191,297 | B2 * | 6/2012 | Gwillim, Jr. | F41A 9/65 | 42/1.02 |
| 8,234,969 | B2 * | 8/2012 | Beckmann | F41A 19/69 | 42/69.01 |
| 8,601,733 | B2 * | 12/2013 | Gabay | F41A 9/62 | 42/1.02 |
| 8,973,294 | B2 * | 3/2015 | Delgado Acarreta | F41A 9/62 | 42/1.02 |
| 2012/0167423 | A1 * | 7/2012 | Kindt | F41A 9/62 | 42/1.02 |
| 2017/0051993 | A1 * | 2/2017 | Imbriano | F41A 19/01 | |

* cited by examiner

*Primary Examiner* — Stephen Johnson
*Assistant Examiner* — Benjamin S Gomberg
(74) *Attorney, Agent, or Firm* — Thompson Hine LLP

(57) ABSTRACT

A system for displaying a number of rounds in a magazine of a weapon may include a force sensitive resistor shaped to be placed in the magazine and engage a magazine spring therein such that a resistance of the force sensitive resistor changes in response to a spring force from a number of rounds in the magazine, a microcontroller connected to detect the resistance of the force sensitive resistor resulting from the spring force upon the force sensitive resistor in response to the number of rounds in the magazine and output an electrical signal indicative of the resistance; and a display connected to respond to the electrical signal, the display having an indicator that is actuated in response to the signal to indicate the number of rounds in the magazine.

20 Claims, 2 Drawing Sheets

SYSTEM AND METHOD FOR DISPLAYING THE NUMBER OF ROUNDS IN A MAGAZINE OF A WEAPON

TECHNICAL FIELD

This disclosure relates to weapons systems and, more particularly, systems and methods for displaying the number of rounds in a magazine of a weapon or firearm.

BACKGROUND

Many modern firearms, such as pistols, shotguns, and rifles, store ammunition in magazines. Magazines store and feed cartridges or rounds to the action or firing chamber of the firearm or weapon. Magazines may be fixed to the weapon, such as the tubular magazine of a lever-action rifle or a pump-action shotgun, or removable, such as the box magazine of semi-automatic and automatic weapons. Both tubular and box magazines include a feed mechanism that may take the form of a spring seated against a fixed surface of the magazine that urges a follower against a stack of rounds of ammunition. In the case of box magazines, the spring urges the follower against a side of the lowermost round of a stack of rounds oriented parallel to each other. With tubular magazines, the spring urges the follower against an adjacent round of a stack of rounds oriented in a line within the tubular magazine.

Such magazines may have capacities for holding rounds that may vary from a few rounds to thirty rounds or more. With most tubular and box magazines, the sides of the magazine are opaque and typically made of metal. Some weapons, such as pistols, receive box magazines into a magazine well formed within the grip. Further, magazines that protrude from the stock of the weapon, such as with semi-automatic rifles, do not contain perforations or other openings that would allow a user to see the number of rounds in the magazine. Consequently, it is difficult if not impossible to determine the rounds remaining in a magazine by a visual inspection. Accordingly, it is necessary for the shooter to mentally keep track of the number of rounds fired and the number of rounds remaining in the magazine.

This necessity of mentally keeping track of the number of rounds remaining in a magazine becomes difficult when the shooter is under stress, such as in a combat situation, a police action, or when hunting, especially after a number of rounds has been fired. Accordingly, there is a need for a system and method that provides an indication to a user indicative of a number of rounds remaining in the magazine of the weapon.

SUMMARY

The present disclosure provides a system and method for indicating the current number of rounds remaining in a magazine of a weapon, which in embodiments may be continuously indicated as the rounds are fired from the weapon. The disclosed system may be incorporated into any type of weapon that stores or accepts rounds contained in a magazine, either removable or otherwise, which in embodiments may take the form of a box magazine or a tubular magazine. The system and method provides an indication of the number of rounds in the magazine that is perceptible by the shooter without having to remove the magazine from the weapon.

In one embodiment, a system for displaying the number of rounds in a magazine of a weapon may include a force sensitive resistor shaped to be placed in the magazine and engage a magazine spring therein such that a resistance of the force sensitive resistor changes in response to a spring force from a number of rounds in the magazine; a microcontroller connected to detect the resistance of the force sensitive resistor resulting from the spring force upon the force sensitive resistor in response to the number of rounds in the magazine and output an electrical signal indicative of the resistance; and a display connected to respond to the electrical signal, the display having an indicator that is actuated in response to the signal to indicate the number of rounds in the magazine.

In another embodiment, a weapon may include a magazine having a spring and a follower for urging rounds into a chamber of the weapon; and a system for displaying a number of rounds in the magazine, the system including a force sensitive resistor positioned in the magazine and engaging the spring such that a resistance of the force sensitive resistor changes in response to a force from the spring compressed by a number of rounds in the magazine, a microcontroller connected to detect the resistance of the force sensitive resistor resulting from the spring force upon the force sensitive resistor in response to the number of rounds in the magazine and output an electrical signal indicative of the resistance, and a display connected to respond to the electrical signal, the display having an indicator that is actuated in response to the signal to indicate the number of rounds in the magazine.

In yet another embodiment, a method for displaying a number of rounds in a magazine of a weapon, in which the magazine has a spring for urging rounds into a chamber of the weapon, includes mounting a force sensitive resistor in the magazine to engage the spring such that a resistance of the force sensitive resistor changes in response to a force from the spring compressed by the number of rounds in the magazine, connecting a microcontroller to detect the resistance of the force sensitive resistor resulting from the spring force upon the force sensitive resistor in response to the number of rounds in the magazine and output an electrical signal indicative of the resistance; and connecting a display to respond to the electrical signal, the display having an indicator that is actuated in response to the signal to indicate the number of rounds in the magazine.

Other objects and advantages of the disclosed system and method for displaying the number of rounds in a magazine of the weapon will be apparent from the following description, the accompanying drawings, and the appended claims.

DETAILED DESCRIPTION

Figure 1:
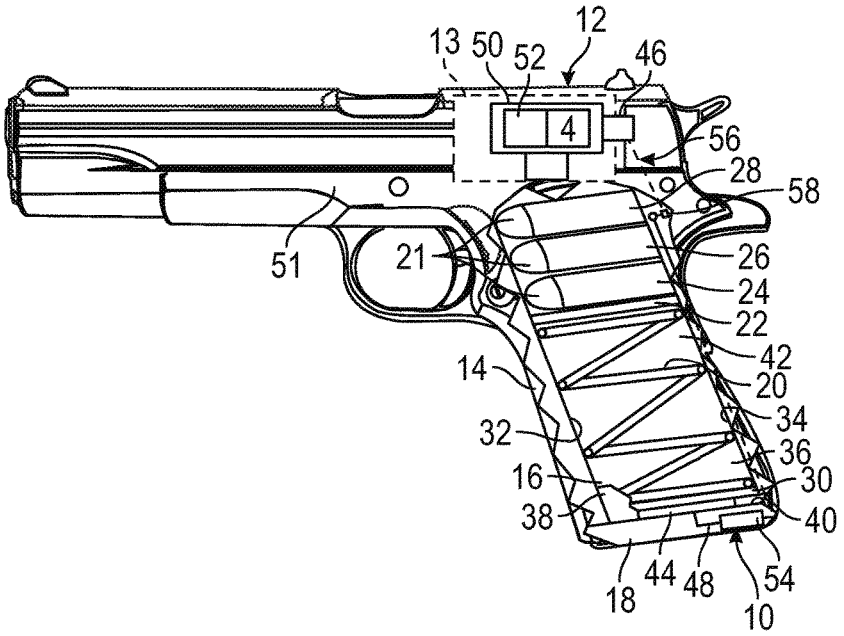
FIG. 1 is a side elevation of the system for displaying the number of rounds in a magazine of a weapon, in which the system is incorporated in a box magazine of the weapon, and in which the magazine well is partially broken away to reveal the magazine, also partially broken away.

As shown in FIG. 1, a system for displaying the number of rounds in a magazine of a weapon, generally designated 10, may be incorporated into a firearm or weapon 12, which is shown as a pistol. The weapon 12 also may take the form of a rifle, such as an AR-15, or any other firearm, which may be a semi-automatic or fully automatic weapon, that utilizes a magazine, which in embodiments may be a removable magazine, to store rounds and feed rounds into the action 13. The weapon 12 may include a grip 14 that includes a magazine well 16 that may receive a magazine 18. In other embodiments, magazine 18 may protrude downwardly or sidewardly from the stock or frame 51 of the weapon 12, in particular if the weapon takes the form of a rifle.

The magazine 18 may include a spring 20 that urges a follower 22 against rounds 21 loaded into the magazine (rounds 24, 26, 28 shown) at an end, which may be an upper end as shown in FIG. 1, and urges against a support plate 30 at an opposite end, which may be a lower end of the magazine 18. The magazine 18 may include side walls 32, 34, 36, and 38 that, together with a bottom wall 40 define an interior chamber 42. The side walls 32-38 and bottom wall 40 are fixed relative to each other. In embodiments, the magazine 18 may be removable from the weapon 12 to facilitate reloading with rounds 21, which may be cartridges. The magazine 18 may vary in capacity from 4 to 15 rounds 21 or more.

The interior chamber 42 is shaped to receive the rounds 21 of ammunition stored in the magazine 18, the follower 22, the spring 20, and the support plate 30. The interior chamber 42 also may enclose and receive a force sensitive resistor 44 and a first microcontroller 54. The force sensitive resistor 44 may be substantially flat and circular, and may be connected to an analog input 48 of the first microcontroller 54. The force sensitive resistor 44 may be seated against, and in embodiments attached to, the fixed bottom wall 40 of the magazine 18 such that the force of the spring 20 urges the force sensitive resistor against the bottom wall.

In the embodiment, the spring 20 may urge against the support plate 30, which in turn urges against the force sensitive resistor 44, which is supported by bottom wall 40, thus transmitting the force of the spring against the force sensitive resistor. Thus, the resistance of the force sensitive resistor 44 varies directly in response to the force of the spring 20 against it. The force of the spring 20 against the force sensitive resistor 44 decreases from a maximum value, when the magazine 18 is fully loaded with rounds 21, to a minimum value, when there are no rounds in the magazine and the magazine is empty.

The force sensitive resistor 44 may be shaped to be placed in the magazine 18 and engage the magazine spring 20 therein such that a resistance of the force sensitive resistor changes in response to a spring force from a number of rounds 22, 24, 26 in the magazine. In an embodiment, the force sensitive resistor may be an Interlink Electronics Model FSR402 force sensing resistor, manufacturer part number 30-81794. The first microcontroller 54 may be connected to detect the resistance of the force sensitive resistor 44 resulting from the spring force upon the force sensitive resistor in response to the number of rounds 21 (rounds 22, 24, 26 shown) in the magazine 18 and output an electrical signal indicative of the measured resistance. In an embodiment, the first microcontroller 54 may be an ATmega328. It is within the scope of the disclosure to utilize other types of microprocessors and microcontrollers.

In an embodiment, the first microcontroller 54 may be programmed to output a signal that corresponds to a resistance value of the force sensitive resistor 44 resulting from the force of the spring 20 upon the force sensitive resistor. The first microcontroller 54 may have stored resistance values corresponding to each number of rounds 21 in the magazine 18, from no rounds (empty), 1 round, 2 rounds, and so on up to maximum capacity, e.g., 15 rounds. In embodiments, the first microcontroller 54 may be associated with a particular magazine 18 that contains a predetermined maximum number of rounds 21 of a predetermined size, weight, and/or caliber. The first microcontroller 54 outputs a different signal or value corresponding to each such number of rounds 21 in the magazine 18. In embodiments, the first microcontroller 54 may be programmed to output signals corresponding to the number of rounds 21 remaining in the magazine 18 continuously as rounds are fired from the weapon 12. Alternatively, the first microcontroller 54 may count rounds 21 dynamically; that is, simply by decrementing the number of rounds by one round each time the resistance of the force sensitive resistor 44 changes by a predetermined value.

The system 10 also may include a display 50 connected to respond to the electrical signals generated by the first microcontroller 54. In embodiments, the display 50 may be selected from a basic 7 segment light-emitting diode ("LED") display, such as a Kingbright part no. SC39-12GWA, a solid state display, such as a Broadcom part no. HDSP-0962, and an ultrathin 7-segment display, such as Kingbright part no. ACSC56-41SRWA-F01. In an embodiment, the display 50 may be mounted on a fixed part of the weapon 12, such as the frame 51, as shown.

In other embodiments, the display 50 may be detached from the weapon 12, in which case the display may take the form of, or be incorporated in, a handheld device that may be held by a trainer or team leader who is not using the weapon 12. In other embodiments, the display 50 may be mounted on or incorporated in a helmet worn by a user or team leader. The display 50 may have an indicator 52 that is actuated in response to the signals to indicate the number of rounds 21 remaining in the magazine 18. In embodiments, the indicator 52 continuously displays the number of rounds 21 remaining in the magazine 18 as the rounds are fired sequentially from the weapon 12 by a user. In embodiments, the indicator 52 may be selected from a visual indicator, which may display a number corresponding to the number of rounds remaining in the magazine 18, or a warning light. In embodiments, the indicator 52 may be mounted on the weapon 12. Also in an embodiment, the indicator 52 may take the form of a non-visual indicator, such as an indicator that emits an audible sound and/or a vibration, such as an audible chime or other alarm.

With each of these embodiments, the system 10 may include a main microcontroller 46. Main microcontroller 46 may be mounted on a fixed part of the weapon 12, such as the frame 51, or the main microcontroller may be attached to or integral with the display 50. The main microcontroller 46 may be programmed to receive a signal from the first microcontroller 54 representative of the number of rounds 21 in the magazine 18, and transmit a signal that actuates the display 50 to actuate the indicator 52 to display a visual or audible signal representative of the number of rounds in the magazine.

In an embodiment, indicator 52 may be selected to emit an audible sound when a predetermined number of rounds 21 remain in the magazine 18. In still other embodiments the display 50 may include an indicator 52 that comprises both a visual and non-visual indicator. With such embodiments, the main microcontroller 46 may be programmed to send signals to the display 50 such that the indicator 52 may visually show a number of rounds 21 remaining in the magazine 18, such as by displaying a number, and/or also emit an audible sound alarm and/or a vibration, for example, when the number of rounds remaining in the magazine 18 reaches a predetermined number of remaining rounds.

The main microcontroller 46 is shaped to be mounted on the weapon 12 and may be similar in type to first microcontroller 54. In an embodiment, the main microcontroller 46 may be mounted on or may be integral with the display 50. The main microcontroller 46 may be connected to receive the signal from the first microcontroller 54 and actuate the display 50. In an embodiment, the first microcontroller 54 may be connected to the main microcontroller 46 by a cable, generally designated 56. The cable 56 may include a power line for supplying electrical power from the main microcontroller 46 to the first microcontroller 54, a ground line, and a data line for exchanging data between the main and second microcontrollers. The cable 56 may include a detachable connection 58 so that the magazine 18 may be removed from the weapon 12, reloaded with rounds 21, and reinserted into the magazine well 16 of the weapon. In other embodiments, the first microcontroller 54 may be connected to the main microcontroller 46 wirelessly, such as by Wi-Fi or a Bluetooth connection. Such a wireless connection may be preferable in embodiments of the system 10 in which the display is physically separate from the weapon 12.

Figure 2:
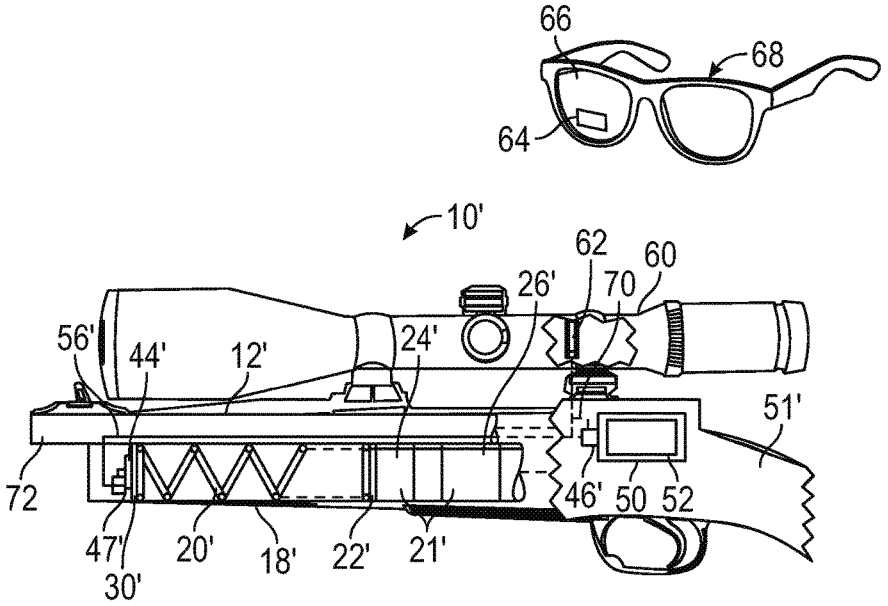
FIG. 2 is another embodiment of the system for displaying the number of rounds in a magazine of a weapon, in which the system is incorporated in a tubular magazine of the weapon.

As shown in FIG. 2, a system for displaying the number of rounds in a magazine of a weapon, generally designated 10', is shown with a weapon 12' having a magazine 18' that may be a tubular magazine. The weapon 12' may be a repeating rifle, such as a lever-action rifle, or a shotgun, such as a pump-action shotgun. The tubular magazine 18' may take the form a cylinder that receives a spring 20', a follower 22' attached to an end of the spring, and a support 30' fixed to the magazine 18'. The tubular magazine 18' may receive rounds 21', which in the embodiment shown in FIG. 4 may take the form of shotgun shells 24', 26'. A main microcontroller 46' may be mounted on the stock 51'. The force sensitive resistor 44' may be mounted on a wall 47' fixed relative to the magazine 18' such that the spring 20' urges against it. In an embodiment, the spring 20' urges against the support plate 30', which in turn urges against the force sensitive resistor 44', thus transmitting the force of the spring against the force sensitive resistor.

The main microcontroller 46' may be connected to a display 50 that may include an indicator 52. As with the embodiment of FIG. 1, the display 50 may be mounted on the weapon 12', such as on the stock 51'. In an alternate embodiment, the weapon 12' may include a telescopic sight 60, mounted on the stock 51', that may include an integral display 62 that receives a signal from the main microcontroller 46' to display a number of rounds 24', 26' remaining in the tubular magazine 18'. The display 62 may take the place of, or be mounted on the weapon 12' in addition to the display 50. The display 62 in the telescopic sight 60 may be connected by a cable 70 either to the main microcontroller 46' or the display 50 receive a signal to actuate the display 62. In the alternative, the display 62 may receive the electrical signal wirelessly from the microcontroller 46'.

The system 10' may include a display 64 that is incorporated into a lens 66 of glasses 68. The display 64 may include a receiver and microcontroller that communicates wirelessly, such as by Wi-Fi or Bluetooth, with either the main microcontroller 46' the display 50 to receive an actuation signal. The glasses 68 may be worn by a user (not shown) of the weapon 12, or in embodiments, the weapon 12'. In other embodiments, the glasses 68 may be worn instead, or in addition, by a trainer or team leader of the user. The weapon 12' may support a cable 56' that connects the force sensitive resistor 44' to the main microcontroller 46'. The cable 56' may extend along the tubular magazine 18' or the barrel 72 of the weapon 12'. In contrast to the cable 56 of FIG. 1, the cable 56' may not need the detachable connection 58 because the tubular magazine 18' may not be removable from the weapon 12'.

With the embodiment of FIG. 2, the main microcontroller 46' is programmed to sense a change in the resistance of the force sensitive resistor 44', convert the change into a number of rounds 21 currently in the magazine 18', and actuate one or more of the display(s) 50, 62, 64 to indicate a number of rounds in the magazine, and/or indicate on indicator 52 the number of rounds in the magazine. Since the magazine 18' of the weapon 12' in FIG. 2 is not removable from the weapon, there is no need for the first microcontroller 54 of the system 10 of FIG. 1. This is because such values as the magazine capacity, spring force, and current number of rounds are always associated with the weapon 12'.

Figure 3:
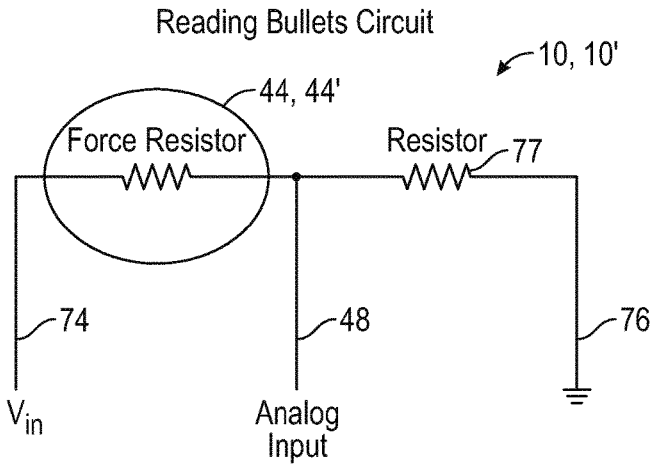
FIG. 3 is a schematic diagram of an embodiment of the electrical circuit of the systems of FIGS. 1 and 2.

As shown in FIG. 3, with each embodiment of the systems 10, 10' shown in FIGS. 1 and 2, respectively, the first and main microcontrollers 54, 46', respectively, communicate with the force sensitive resistors 44, 44' by an analog input. The first and main microcontrollers 54, 46' each also may include a power source communicating with an input 74 and a ground 76 connection. The analog input 48 also may be connected to a resistor 77, which is located between the analog input and ground, that operates to keep the input grounded.

Figure 4:
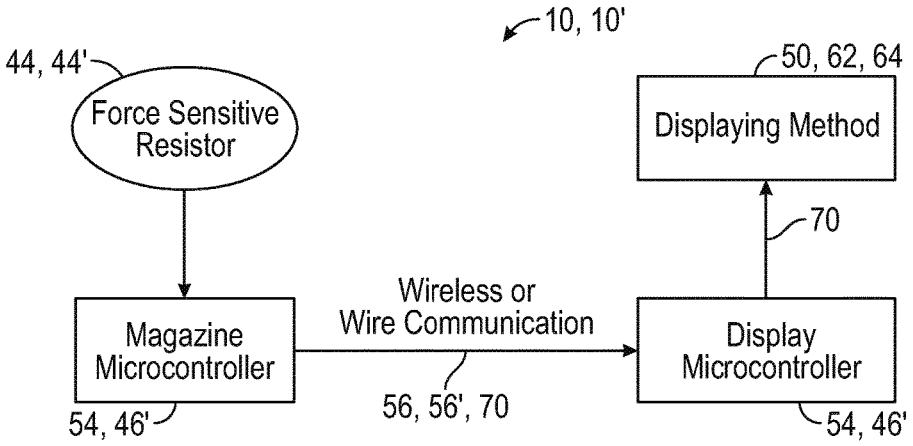
FIG. 4 is a block diagram showing the systems of FIGS. 1 and 2.

As shown in FIG. 4, the schematic of the systems 10, 10' includes a force sensitive resistor 44, 44' that communicates with a magazine microcontroller (in embodiments, first microcontroller 54, and main microcontroller 46') that in embodiments may be mounted within the magazine 18, in the case of a removable magazine, or on the stock 51' in the case of a fixed or non-removable magazine (see FIGS. 1 and 2). The magazine microcontrollers 54, 46' may communicate with a display controller 46, or the display microcontroller may be integral or unitary with the magazine controller 54, 46'. In the former embodiment, the communication may be effected either by the communication cable 56, or wirelessly. The display microcontroller 54, 46' may communicate with one or more of the displays 50, 62, 64. In embodiments, the communication may be wirelessly or by a cable 56, 70, as shown in FIG. 4. Also in embodiments, the display microcontroller 54, 46' may be attached to or integrated with the display 50.

The method for displaying the number of rounds 21 21' currently in a magazine 18, 18' of a weapon 12, 12' is as follows. A force sensitive resistor 44, 44' may be mounted in the magazine 18, 18' of a weapon 12, 12' to engage a spring 20, 20' in the magazine such that a resistance of the force sensitive resistor changes in response to changes in the force from the spring as it is compressed by a number of rounds 21, 21' in the magazine. A microcontroller 54, 46' may be connected to the force sensitive resistor 44, 44' to detect the resistance of the force sensitive resistor resulting from the spring force from the spring 20, 20' upon the force sensitive resistor in response to the current number of rounds 21 in the magazine 18, 18' and output an electrical signal indicative of the resistance.

The microcontroller 54, 46' may be connected to a display 50, 62, 64 (the former microcontroller 54 by way of main microcontroller 46). The display 50, 62, 64 responds to the electrical signal from the microcontroller 46, 46', and may include an indicator 52 that is actuated in response to the signal to indicate the number of rounds 21, 21' in the magazine 18, 18'. A user (not shown) may thus detect the number of rounds 21 remaining the magazine 18, 18' at any time during firing of the weapon 12, 12'. In embodiments, the display 50 may include an indicator 52 that may be visual and/or produce an audible sound corresponding to the number of rounds currently in the magazine 18, 18'. Also in embodiments, the display 50 may include or be connected with a second microcontroller 46' that is configured to actuate the display in response to the signal from the microcontroller 54.

The systems 10, 10' thus provide an easily configurable means for continuously displaying the current number of rounds in a magazine of a weapon as the rounds are fired from the weapon that eliminates the need to remove the magazine from the weapon in order to determine the rounds remaining, or to require a user to mentally keep track of a number of rounds remaining in the magazine during use.

While the systems and methods disclosed herein constitute preferred embodiments of the disclosed system and method for displaying the number of rounds in a magazine of a weapon, it is to be understood that the invention is not limited to these precise systems and methods, and that modifications may be made to the systems and methods without departing from the scope of the invention.

What is claimed is:

1. A system for displaying a number of rounds in a magazine of a weapon, the magazine including a spring that urges a follower against rounds loaded into the magazine, the system comprising:

a support plate in the magazine, the spring urging against the support plate at an end of the spring opposite the follower;

a force sensitive resistor seated against a fixed bottom wall of the magazine, the spring urging the support plate against the force sensitive resistor, wherein a force of the spring proportional to the number of the rounds in the magazine is transmitted by the support plate against the force sensitive resistor, such that a resistance of the force sensitive resistor changes in response to a change in the spring force from a change in the number of rounds in the magazine;

a first microcontroller connected to the force sensitive resistor to measure a resistance value of the force sensitive resistor resulting from the spring force upon the force sensitive resistor, and to output an electrical signal indicative of the measured resistance value of the force sensitive resistor; and a display connected to respond to the electrical signal, the display having an indicator that is actuated in response to the electrical signal to indicate the number of rounds in the magazine.

2. The system of claim 1, wherein the indicator is selected from a visual indicator and a non-visual indicator.

3. The system of claim 2, wherein the visual indicator displays a number corresponding to the number of rounds in the magazine.

4. The system of claim 2, wherein the indicator is mounted on the weapon.

5. The system of claim 4, wherein the visual indicator is integrated into an aiming device on the weapon, the aiming device selected from a telescopic sight, red dot sight, and a flip sight.

6. The system of claim 2, wherein the visual indicator is integrated into glasses worn by a user of the weapon.

7. The system of claim 2, wherein the non-visual indicator emits an audible sound and/or a vibration when a predetermined number of rounds of the number of rounds in the magazine remains in the magazine.

8. The system of claim 1, wherein the first microcontroller is programmed to convert the resistance measured by the force sensitive resistor to the number of rounds in the weapon magazine.

9. The system of claim 1, wherein the magazine is selected from a tubular magazine and a box magazine.

10. The system of claim 1, wherein the first microcontroller is mounted on the magazine.

11. The system of claim 10, further comprising a main microcontroller mounted on the weapon; the main microcontroller connected to receive the electrical signal from the first microcontroller and actuate the display.

12. The system of claim 11, wherein the main microcontroller is connected to the first microcontroller by a power line for supplying electrical power to the first microcontroller, a ground line, and a data line, wherein the power line, the ground line, and the data line are detachable.

13. The system of claim 11, wherein the main microcontroller receives a wireless signal from the first microcontroller.

14. A weapon for firing rounds of ammunition, the weapon comprising:

a magazine having a spring and a follower for urging the rounds into a chamber of the weapon; and a system for displaying a number of the rounds in the magazine, the system including a support plate in the magazine, the spring urging against the support plate at an end of the spring opposite the follower;

a force sensitive resistor seated against a fixed bottom wall of the magazine, the spring urging the support plate against the force sensitive resistor, wherein a force of the spring proportional to the number of the rounds in the magazine is transmitted by the support plate against the force sensitive resistor, such that a resistance of the force sensitive resistor changes in response to a change in the spring force from a change in the number of rounds in the magazine, a first microcontroller connected to the force sensitive resistor to measure a resistance value of the force sensitive resistor resulting from the spring force upon the force sensitive resistor, and to output an electrical signal indicative of the measured resistance value of the force sensitive resistor; and a display connected to respond to the electrical signal, the display having an indicator that is actuated in response to the electrical signal to indicate the rounds in the magazine.

15. The weapon of claim 14, wherein the first microcontroller is programmed to convert the resistance measured by the force sensitive resistor to the number of rounds in the weapon magazine.

16. The weapon of claim 14, wherein the indicator is selected from a visual indicator and a sound indicator.

17. The weapon of claim 14, further comprising a main microcontroller mounted on the weapon; the main microcontroller connected to receive the electrical signal from the first microcontroller and actuate the display.

18. The weapon of claim 17, wherein the main microcontroller is connected to the first microcontroller either by the combination of a power line for supplying electrical power to the first microcontroller, a ground line, and a data line, wherein the power line, the ground line, and the data line are detachable; or by wireless communication.

19. The weapon of claim 14, wherein the magazine is selected from a tubular magazine and a box magazine.

20. A method for displaying a number of rounds in a magazine of a weapon, the weapon having a spring that urges a follower against the rounds into a chamber of the weapon, the method comprising:

mounting a support plate in the magazine, such that an end of the spring opposite the follower urges against the support plate;

mounting a force sensitive resistor seated against a fixed bottom wall of the magazine to engage the support plate, so that the spring urges the support plate against the force sensitive resistor, wherein a force of the spring proportional to the number of rounds in the magazine is transmitted by the support plate against the force sensitive resistor, such that a resistance of the force sensitive resistor changes in response to a change in the force from the spring from a change in the number of rounds in the magazine;

connecting a first microcontroller to measure a resistance value of the force sensitive resistor resulting from the spring force upon the force sensitive resistor, and to output an electrical signal indicative of the measured resistance value of the force sensitive resistor; and connecting a display to respond to the electrical signal, the display having an indicator that is actuated in response to the electrical signal to indicate the number of rounds in the magazine.

* * * * *